US011565431B2

(12) United States Patent
Levine et al.

(10) Patent No.: US 11,565,431 B2
(45) Date of Patent: Jan. 31, 2023

(54) PERSONAL SAFETY DEVICE

(71) Applicant: ALBL LLC, Gaithersburg, MD (US)

(72) Inventors: Jeffrey C. Levine, North Potomac, MD (US); Joshua D. Levine, North Potomac, MD (US); Evan M. Levine, North Potomac, MD (US)

(73) Assignee: ALBL LLC, Gaithersburg, MD (US)

( * ) Notice: Subject to any disclaimer, the term of this patent is extended or adjusted under 35 U.S.C. 154(b) by 0 days.

(21) Appl. No.: 15/996,680

(22) Filed: Jun. 4, 2018

(65) Prior Publication Data

US 2019/0134830 A1 May 9, 2019

Related U.S. Application Data

(63) Continuation-in-part of application No. 14/120,552, filed on Jun. 4, 2014, now Pat. No. 9,987,758.

(51) Int. Cl.

| | |
|---|---|
| ***B26B 1/08*** | (2006.01) |
| ***F41B 13/00*** | (2006.01) |
| ***F41B 15/08*** | (2006.01) |
| ***G08B 25/01*** | (2006.01) |
| ***B26B 11/00*** | (2006.01) |

(52) U.S. Cl.

CPC ..... *B26B 1/08* (2013.01); *B26B 11/008* (2013.01); *F41B 13/00* (2013.01); *F41B 15/08* (2013.01); *G08B 25/016* (2013.01)

(58) Field of Classification Search

CPC .. B26B 1/00; B26B 1/08; B26B 29/02; B26B 11/008; F41B 15/00; F41B 15/08; F41B 13/00; Y10T 29/49828; G08B 25/016

See application file for complete search history.

(56) References Cited

U.S. PATENT DOCUMENTS

| | | | | | |
|---|---|---|---|---|---|
| 1,181,681 | A * | 5/1916 | Nicaud | B26B 29/02 | 30/151 |
| 2,099,447 | A * | 11/1937 | Matsuyama | F41B 15/06 | 463/47.4 |
| 2,741,025 | A * | 4/1956 | Stewart | F41B 15/06 | 30/151 |
| 2,845,659 | A * | 8/1958 | Calvert | C08L 21/00 | 264/50 |
| 4,096,629 | A * | 6/1978 | Levine | B26B 1/00 | 30/152 |
| 5,079,801 | A * | 1/1992 | Peterson | B26B 13/06 | 30/122 |
| 6,070,326 | A * | 6/2000 | Berns | B26B 29/02 | 30/2 |
| 6,122,828 | A * | 9/2000 | Asterino, Jr. | B26B 3/06 | 30/151 |

(Continued)

*Primary Examiner* — Jonathan G Riley

(74) *Attorney, Agent, or Firm* — NovoTechIP International PLLC

(57) ABSTRACT

A protective device and a method of transmitting an alert from the device, in which the protective device is handheld and includes a flexible sheath disposed between an upper member and a lower member. When the device is compressed, elongated defensive components protrude through openings in the upper member. In some cases, the upper member also includes protruding portions extending upward from the upper member and/or an arm portion extending outward to a side of the device. A signal alert may be automatically transmitted upon device compression.

8 Claims, 13 Drawing Sheets

(56) References Cited

U.S. PATENT DOCUMENTS

| | | | | |
|---|---|---|---|---|
| 6,394,518 | B1 * | 5/2002 | Kelley | B25B 27/0092 294/61 |
| D500,546 | S * | 1/2005 | Anderson | D22/117 |
| D510,121 | S * | 9/2005 | Blair | D22/117 |
| D528,893 | S * | 9/2006 | Budd | D22/118 |
| 2003/0061714 | A1 * | 4/2003 | Pope | B24D 15/084 30/138 |
| 2010/0236077 | A1 * | 9/2010 | Shirey | B26B 1/02 30/152 |
| 2012/0066910 | A1 * | 3/2012 | Shantha | B26B 1/02 30/122 |

* cited by examiner

PERSONAL SAFETY DEVICE

CROSS-REFERENCE TO RELATED APPLICATION

This application is a continuation-in-part of Levine et al., U.S. patent application Ser. No. 14/120,552, entitled "Protective Weapon," filed on Jun. 4, 2014, and to be issued as U.S. Pat. No. 9,987,758, which is incorporated herein by reference in its entirety.

BACKGROUND

There are many situations in which the personal safety of an individual is at risk from an attacker. For example, violent crimes, such as robbery, rape and assault, frequently occur while the victim is walking to or from a vehicle or a residence. Oftentimes these victims are women. The crimes of molestation, rape and assault, in particular, are frequently directed at exercisers, such as walkers, hikers and joggers, who are preoccupied with the exercise activity and thus are vulnerable to a sudden attack. Exercisers are also more vulnerable to an attack because it is difficult to carry a device for protecting against an attack while exercising.

Most of the presently available self-defense devices are not suitable for a large percentage of the population. For example, many people do not wish to carry a gun and do not have the physical capacity to use a club or other bulky weapon against an attacker. There remains a need for a personal safety device that provides a strong deterrent to attackers, is safe for the user, portable, and is readily used in a natural and/or reflexive self-defense mode.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

In one general aspect, the present disclosure is directed to a protective device that includes a housing including an upper member, a lower member, and a flexible sheath that extends between the upper member and the lower member. Furthermore, the upper member is substantially more rigid than the flexible sheath, the housing surrounds a cavity, and the housing is sized and dimensioned to fit in a human hand. In addition, the protective device includes a first protruding portion and a second protruding portion, each protruding portion extending distally outward from the upper member, and having an activated state and a deactivated state, wherein the flexible sheath is compressed in the activated state such that a height of the housing is decreased.

The above general aspect may include one or more of the following features. For example, the protective device can also include a first groove disposed between the first protruding portion and the second protruding portion, and/or at least a first defensive component disposed within the cavity, the first defensive component being substantially elongated in a direction substantially parallel to an orientation of the first protruding portion. In some cases, the first defensive component includes a body portion and an upper portion, wherein the body portion has an outer surface that is substantially blunt, and the upper portion includes a blunt concave surface extending from the body portion to an outermost tip portion. As another example, the device includes a third protruding portion extending distally outward from the upper member, wherein the first protruding portion, the second protruding portion, and the third protruding portion are disposed in a substantially parallel arrangement. In some implementations, a second groove is disposed between the second protruding portion and the third protruding portion and/or the lower member is more rigid than the flexible sheath. In one example, the first protruding portion includes an apex portion that is substantially rounded, and/or the first protruding portion includes an apex portion that includes a plurality of bumps. In addition, the device can include an arm portion extending distally outward in an orientation substantially perpendicular to an orientation of the first protruding portion In another general aspect, the present disclosure is directed to a protective device that includes a housing including an upper member, a lower member, and a flexible sheath that extends between the upper member and the lower member. The upper member is substantially more rigid than the flexible sheath, the housing surrounds a cavity, and the housing is sized and dimensioned to fit in a human hand. The protective device also includes an arm portion extending distally outward from a lateral side region of the upper member in a first direction, as well as a first defensive component disposed within the cavity, the first defensive component being substantially elongated in a direction perpendicular to the first direction.

The above general aspect may include one or more of the following features. In a first example, the first defensive component can include a body portion and an upper portion, and the body portion has an outer surface that is substantially blunt, and the upper portion includes a blunt concave surface extending from the body portion to an outermost tip portion. In some implementations, the protective device is operable in an activated state and a deactivated state, wherein the body portion is disposed entirely within the flexible sheath in the deactivated state and/or wherein the upper portion is disposed entirely outside of the housing in the activated state. In another example, the protective device also includes a second defensive component and a third defensive component arranged in parallel with the first defensive component.

In another general aspect, the present disclosure is directed to a method of transmitting an alert from a defensive device. The method includes compressing a flexible sheath of the device, thereby bringing an upper member and a lower member of the device closer together, exposing a plurality of elongated defensive components through openings in the upper member, and transmitting a first signal to a network when contact between a first sensing component and a second sensing component occurs.

The above general aspect may include one or more of the following features. The method can also include transmitting a second signal to a remote mobile device or to a local law enforcement agency. In some implementations, the method also includes transmitting a position of the device to a network when contact between a first sensing component and a second sensing component occurs. As another example, the method can include switching the device from a disabled mode to an enabled mode.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION

In the following detailed description, numerous specific details are set forth by way of examples in order to provide a thorough understanding of the relevant teachings. However, it should be apparent that the present teachings may be practiced without such details. In other instances, well known methods, procedures, components, and/or circuitry have been described at a relatively high-level, without detail, in order to avoid unnecessarily obscuring aspects of the present teachings.

The following description provides various implementations of a handheld personal safety device and protective weapon. As noted above, there are few personal safety devices that can be easily carried and used by the general population. One significant problem with most of the commercially available stabbing or sharp-edged devices is the risk they pose to the user both before and during use. Weapons that include an uncovered sharp edge, such as a knife, have the potential to injure the user while being transported or carried. Storing an uncovered stabbing or cutting tool is impractical in most purses or bags because self-inflicted wounds and damage to such containers are too likely. One solution has been to cover the sharp edge(s) when the weapon not in use, but this renders such a device useless for the average person. During the confusion and stress of a personal attack, having to physically unsheathe or uncover a weapon before use will not be easy or even possible for most users. If the user is obligated to remember to activate, or uncover, or perform any other physical action that is not instinctive or autonomous in a defensive mode, it is too likely that the device will not be used effectively. Thus, a self-defense weapon must be continuously ready for reflexive and/or immediate use to be effective. To ensure that the weapon is properly used and available in real-life attack situations, the weapon should integrate into the natural reflexive actions of persons in a mode of self-defense.

The present implementations provide for a small, portable, lightweight, easy to use "claw" weapon that can be carried and safely stored by the user, yet rapidly activated when needed to repel an assault. In different implementations, a protective sheath isolates one or more elongated defensive components (identified and referred to previously as blades in the "Protective Weapon" application) in the body of the weapon configured to protect the user when not activated. To activate, the user squeezes the weapon, and the protective sheath constricts, thereby exposing the portions of the defensive components for use against an attacker. When the user relaxes their grip, the protective sheath expands to again sheathe the defensive components in the body of the weapon and protect the user from the defensive components.

Figure 1:
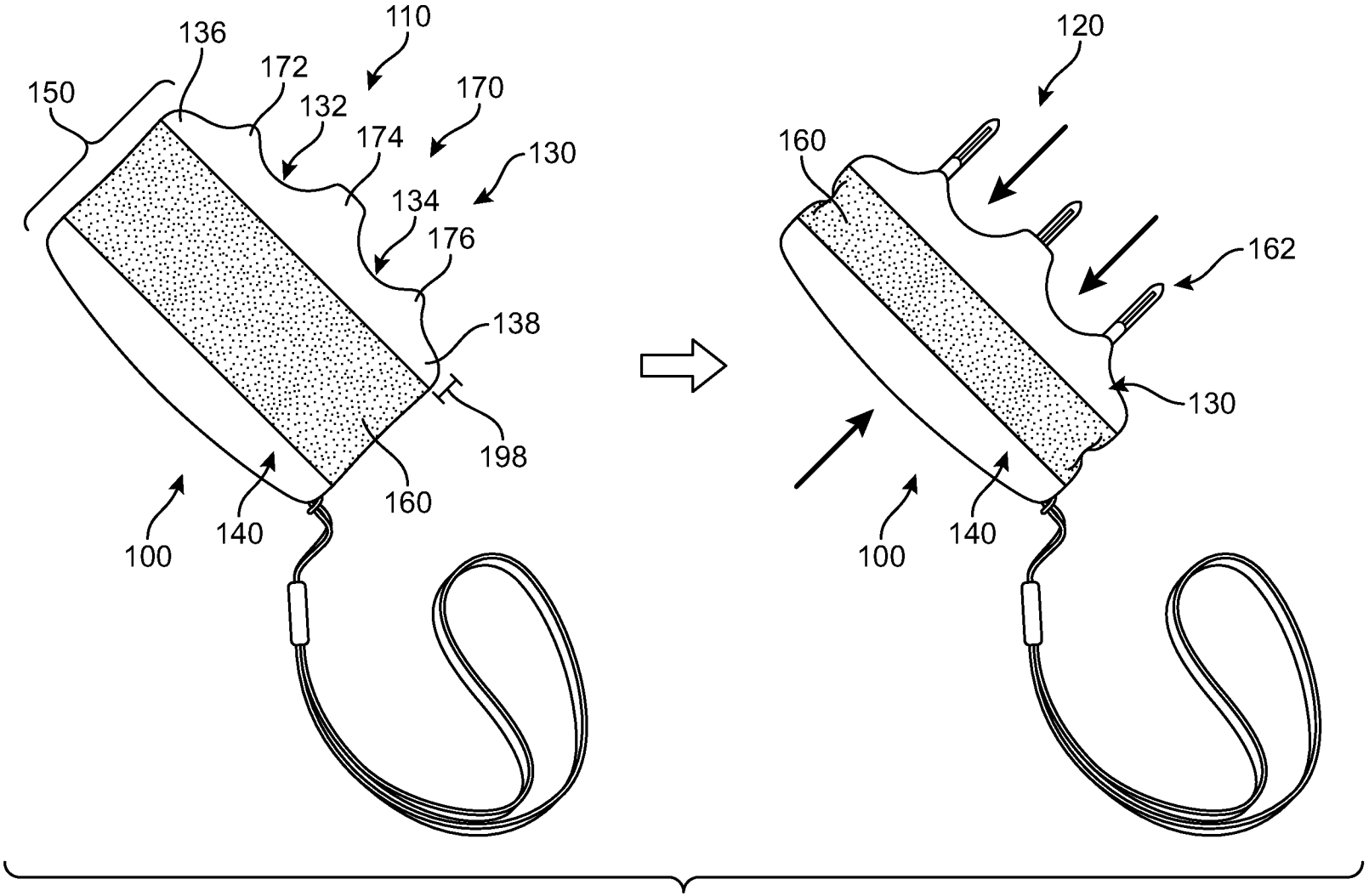
FIG. 1 is a top down view of an implementation of a device in a first state and a second state.

For purposes of clarity, one implementation of a protective device ("device") 100 is presented in FIG. 1, in both a deactivated state 110 and an activated state 120. Referring to the deactivated state 110 shown in FIG. 1, it can be seen that the first device 100 includes a housing 150. In different implementations, the housing 150 includes a first upper member 130, a lower member 140, and a compressible or flexible sheath 160 extending between the first upper member 130 and the lower member 140. In some implementations, the deactivated state 110 can be understood to represent the default or initial state of the first device 100. In other words, if no external force is applied, the first device 100 will remain in the deactivated state 110.

However, when a compressive force is applied to the first device 100, it can transition from the deactivated state 110 to the activated state 120, as presented in FIG. 1. As the first device 100 is squeezed, the first upper member 130 and the lower member 140 can move toward one another as the flexible sheath 160 is compressed. As this occurs, it can be seen that at least some portions of a plurality of defensive components ("defensive components") 162 are exposed. In FIG. 1, the defensive components 162 extend or protrude outward from corresponding openings formed in the first upper member 130. It may be understood that the first device 100 returns to the deactivated state 110 when the compressive force is removed.

In some implementations, the first upper member 130 includes an undulated or curved outer surface to facilitate the placement of a user's fingers. For example, in FIG. 1, three raised portions 170 extend distally outward from a base portion 198 of the first upper member 130, including a first raised portion 172, a second raised portion 174, and a third raised portion 176. In this case, the first raised portion 172 and the third raised portion 176 are substantially similar. However, the raised portions may be modified and can vary in size and geometry in different implementations, and/or the raised portions may be disposed elsewhere along the first upper member 130, as will be discussed further below with respect to FIGS. 3-8.

For purposes of reference, the implementations described herein will be associated with various directional identifiers. Thus, the directional identifiers described herein are applicable to each implementation discussed below. For example, referring to the isometric view of FIG. 2, first device 100 is understood to be configured with an anterior side 280 and a posterior side 282. The first device 100 may also include a first lateral side 284 and a second lateral side 286. Furthermore, first device 100 may also include a superior side 278 and an inferior side 288.

Reference is also made to directions or axes that are relative to the device itself, rather than to its intended orientation with regards to a user's hand or body. For example, the term "distal" refers to a part that is located further from a center of a device, while the term "proximal" refers to a part that is located closer to the center of the device. As used herein, the "center of the device" could be the center of mass and/or a central plane and/or another centrally located reference surface. In addition, the term "outermost" refers to a position that is most distal in a specified direction or along a particular axis.

Figure 2:
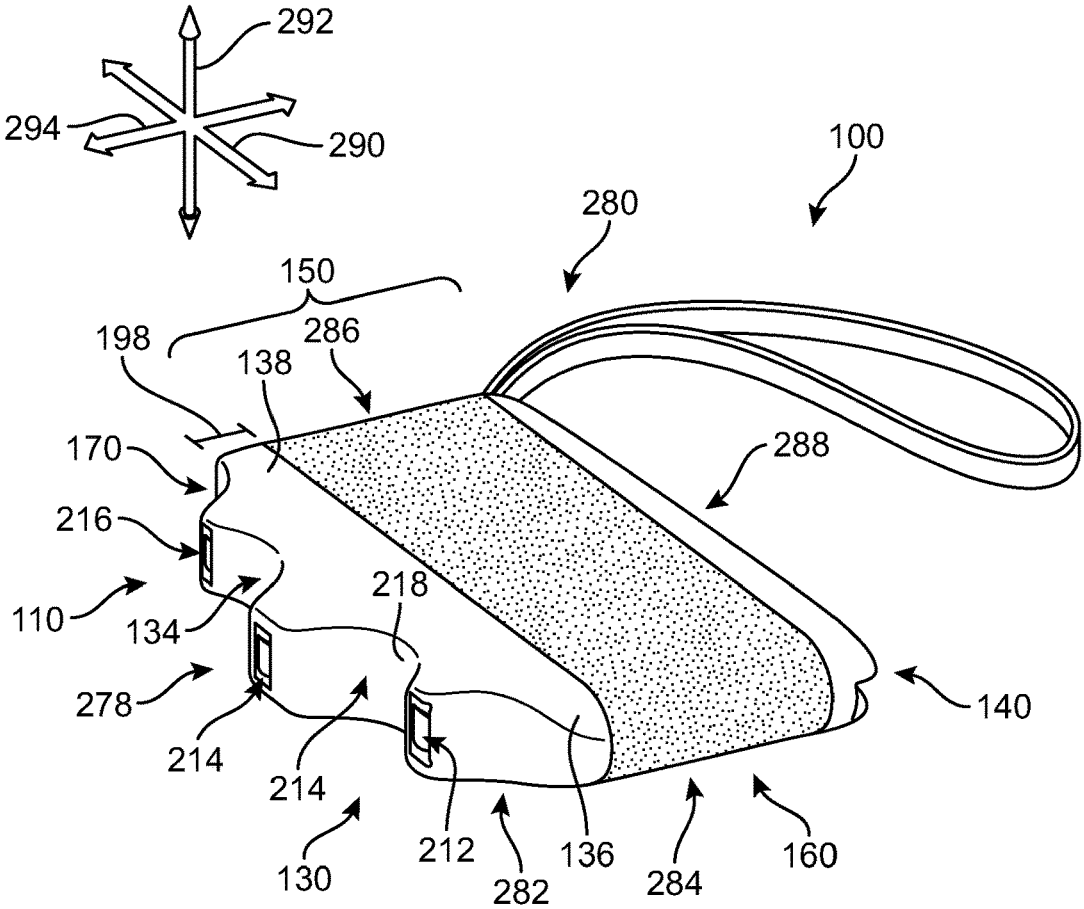
FIG. 2 is an isometric view of an implementation of the device in the first state and the second state.
Figure 2:
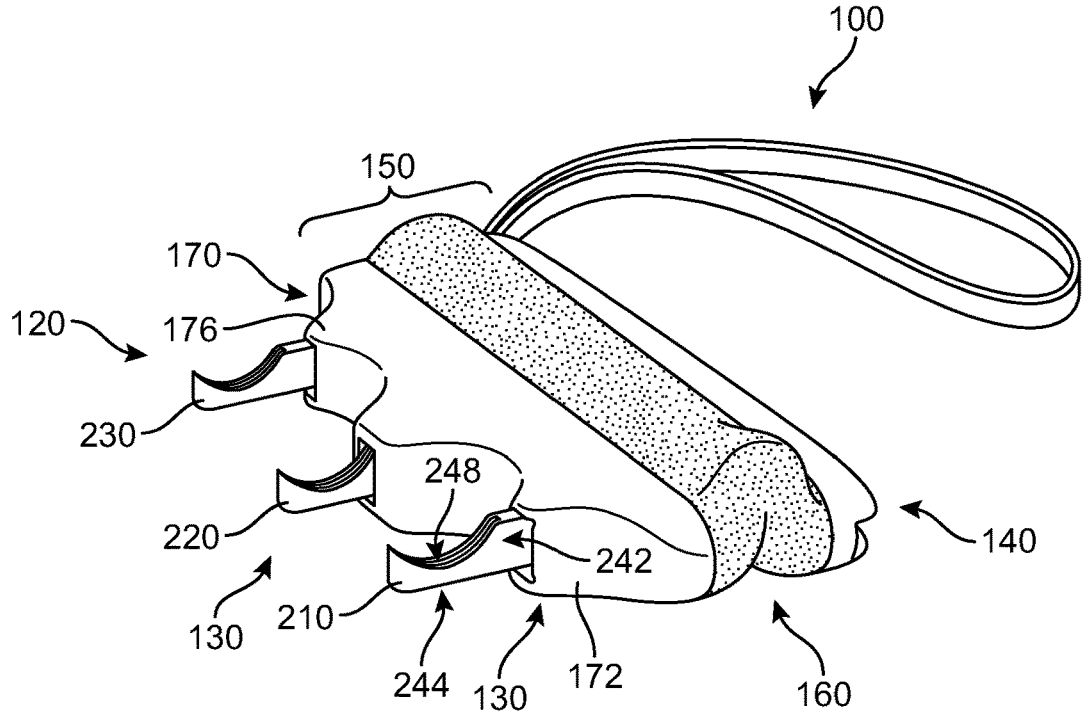

Throughout this description, a device may also be associated with various axes. Referring to FIG. 2, first device 100 may be associated with a longitudinal axis 290 that extends along the longest dimension of device 100 between first lateral side 284 and second lateral side 286. References to the term "width" are relative to the longitudinal axis 290. Additionally, first device 100 may be associated with a posterior-anterior axis 292 (also referred to as a "thickness axis") that extends along the dimension of first device 100 extending between posterior side 282 and anterior side 280. References to the term "thick" are relative to the anterior-posterior axis 292. Moreover, first device 100 may be associated with a vertical axis 294 that extends along the thickness dimension of first device 100 and which is generally perpendicular to both longitudinal axis 290 and posterior-anterior axis 292. References to the terms "height" or "length" are relative to the vertical axis 294.

A device may also be associated with various reference planes or surfaces. As used herein, the term "median plane" refers to a vertical plane which passes from the anterior side to the posterior side of the device, dividing the device into right and left halves, or lateral halves. As used herein, the term "transverse plane" refers to a horizontal plane located in the center of the device that divides the device into superior and inferior halves. As used herein, the term "coronal plane" refers to a vertical plane located in the center of the device that divides the device into anterior and posterior halves. In some embodiments, various implementations of the device are symmetric or substantially symmetric about two planes, such as the median plane and/or the transverse plane.

Referring now to the enlarged isometric view of the first device 100 in FIG. 2, greater detail regarding the defensive components 162 may be observed. These defensive components were identified as "blades" in the above-referenced copending U.S. patent application Ser. No. 14/120,552. In FIG. 2, it can be seen that each raised portion is associated with a defensive component. For example, in the lower half of FIG. 2, in response to a compressive force, a first defensive component ("first component") 210 emerges from a first opening 212 in the first raised portion 172, a second defensive component ("second component") 220 emerges from a second opening 214 in the second raised portion 174, and a third defensive component ("third component") 230 emerges from a third opening 216 in the third raised portion 176. Thus, the housing 150 includes a cavity or enclosed space within or inside the device that is configured to store or substantially enclose the defensive components. In one implementation, the openings in each raised portion provide a means of fluid communication between the external environment and the internal (within the device) space or environment.

In some implementations, the defensive components are disposed in a substantially parallel arrangement. Each defensive component comprises an inner portion extending from an elongated portion of the body. For example, in FIG. 2, the first component 210 includes an inner base portion 242 which is largely hidden from view behind or within the housing 150 as well as an outer portion 244. (Base portion 242 is identified as a 'body portion' in the "Protective Weapon" application.) Furthermore, in different implementations, it can be understood that the base portion 242 is of a first length, and the outer portion 244 is of a second length less than the second length. In addition, the base portion 242 can be substantially blunt (in other words, the base is not configured for cutting, and is non-sharp or non-pointed) in some implementations. For example, the base portion can include a rectangular cross-section or a rounded cross-section. As discussed in greater detail in the "Protective Weapon" application, in some implementations, the base portion includes a forward-facing surface ("forward surface"), a first side surface, and a second side surface.

In addition, it can be seen that the upper portion 244 includes a concave surface 248 that extends from the forward surface to an outermost tip portion 246. The concave surface 248 curves inward relative to the forward surface and, in some implementations, can terminate at a sharp, pointed end on the outermost tip portion 246. The forward surface can also be understood to include a first width, while the concave surface 248 includes a second width, and the first width is greater than the second width. In some implementations, the concave surface 248 tapers in width as it approaches the outermost tip portion 246.

Furthermore, in the deactivated state 110, the defensive component are disposed, maintained, stored, enclosed, contained, and/or secured within the flexible sheath, where the flexible sheath 160 includes a flexible and compressible material that extends between the relatively rigid upper member 130 and the relatively rigid lower member 140. The upper member 130 is substantially more rigid than the flexible sheath 160.

The differing rigidities of the components in a device may be achieved in various ways. In some implementations, the sheath may include a first material and the upper member and/or lower member may include a second material. In one implementation, the first material and second material may be substantially different materials having substantially different rigidities. In particular, the first material may be made of a semi-rigid material, including one or more of, but not limited to, rubber (natural and synthetic), elastic, foam (open and closed cell), sponge, cork, spandex fibers, stretch vinyl, nylon, springs, elastomers, viscoelastic materials, and/or other deformable materials. In addition, the second material may be a substantially rigid material, including, but not limited to plastics, polymers, aluminum, steel, carbon fiber, titanium, wood, nylon, polyurethane, polyvinyl chloride, thermoplastic, stiff rubbers, polyvinyl chloride, and/or other rigid or resilient materials. Furthermore, the second material can include features or materials that facilitate a good grip on the device, such as texturing or high-friction materials. However, it will be understood that any other materials with increasing levels of rigidity could be used. In still other embodiments, it may be possible to modify the rigidity of one or more member (upper member or lower member) by varying the geometry and/or structure of the members.

Referring again to FIGS. 1-2, it can be seen that in the deactivated state the body portion is disposed entirely within the sheath while in the activated state at least a portion of the body portion extends out of the sheath. In addition, the height of the sheath can decrease as the weapon transitions from the deactivated state to the activated state. For example, in the activated state shown in FIG. 1, the flexible sheath 160 has a first height, and in the deactivated (uncompressed) state shown, the flexible sheath 160 has a second height, where the first height is less than the second height. In order for the defensive components 162 to be exposed when the weapon is in the activated state, in the activated state the first height of the sheath portion is substantially smaller than the first length of the body portion 242, thereby revealing portions of the defensive components. Furthermore, as shown in FIGS. 1 and 2, it can be understood that, in some implementations, the upper portion 244 extends entirely out of the sheath in the activated state while the upper portion 244 is substantially enclosed within or surrounded by the upper member 130 in the deactivated state. Thus, in one implementation, a person's exposure to the upper portion 244 of a defensive component occurs when the device is in the activated state. As described herein, the weapon is configured to transition from the deactivated state to the activated state when a compressive force is applied to the rigid upper member 130 and the rigid lower member 140, and to elastically return to the deactivated state when the compressive force is removed.

It can further be seen that each raised portion is spaced apart to facilitate a ready, comfortable grip in a user's hand. Specifically, disposed between each pair of raised portions is a concave portion, recess, or dip that is configured to snugly, comfortably, and/or readily receive a width of a human finger. Referring back to FIGS. 1 and 2, the first device 100 includes a first recess 132 and a second recess 134 that are each configured for placement of a human finger. In different implementations, the recesses may differ in dimensions and shape, as will be discussed below. It can be further observed and understood that as the devices described herein are configured as a personal weapon, they are each sized and dimensioned to fit snugly and/or comfortably in a person's hand. Thus, the distance between the lower edge or nadir of a recess in the upper member and a bottommost edge of the device will be small enough to easily rest or be held in a human palm. For ease of reference, the upper member, lower member, and flexible sheath will be referred to as a single unit (the device housing), with a height of the housing being the distance between the lower edge or nadir 218 of a recess in the upper member and a bottommost edge of the device. In other words, the heights described herein for the housing will include the base portion 198 of the upper member 130, the sheath, and the lower member, but will not include the heights of the raised portions. This is to facilitate discussion of the changing dimensions of the raised portions, as will be presented below. Thus, additional structural features of the devices that are discussed below will be considered to extend beyond or be disposed outside the housing, and will serve to lengthen the height of the device or increase the width of the protective device as a whole.

Figure 3:
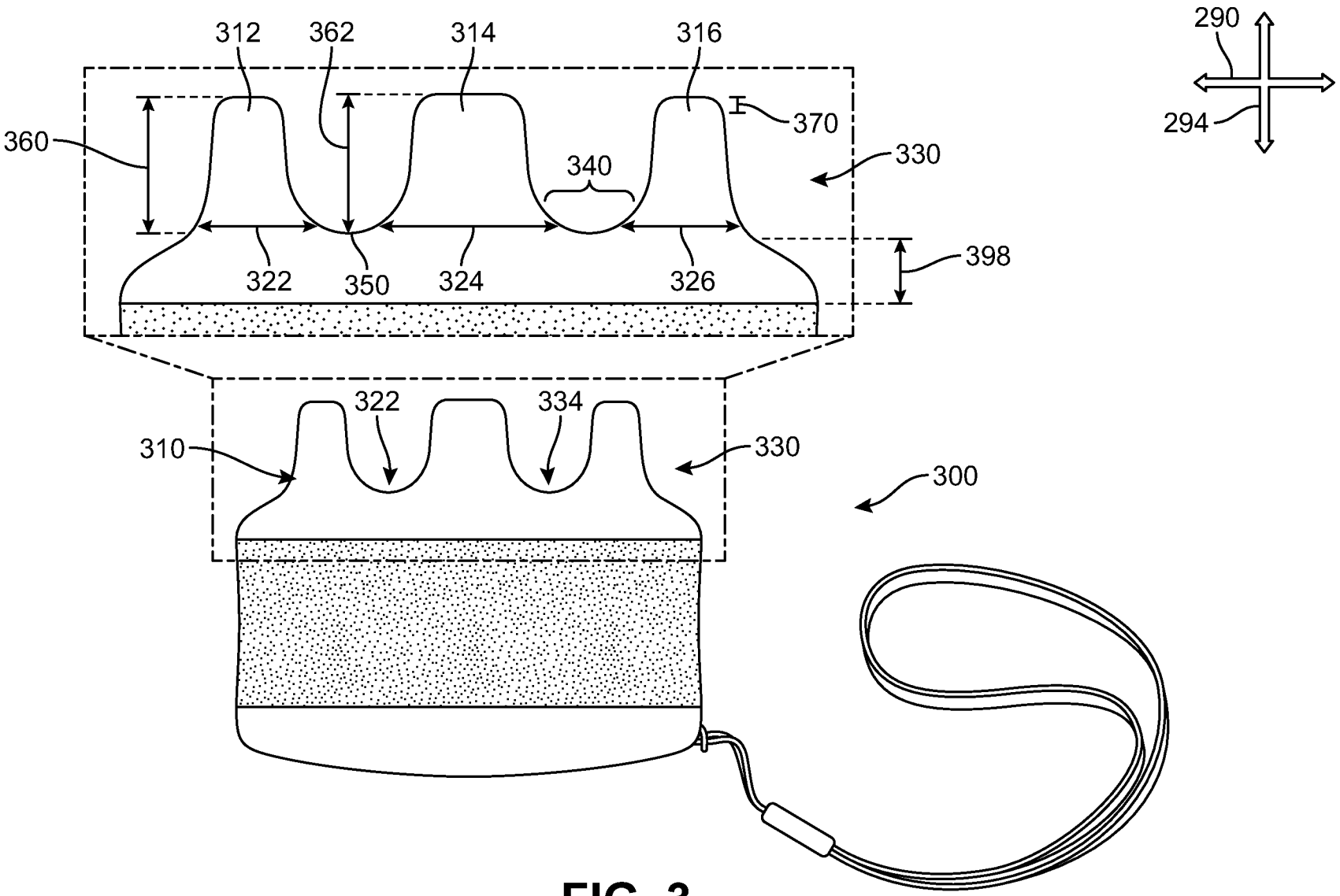
FIG. 3 is a side view of an implementation of a device with protruding portions.
Figure 4:
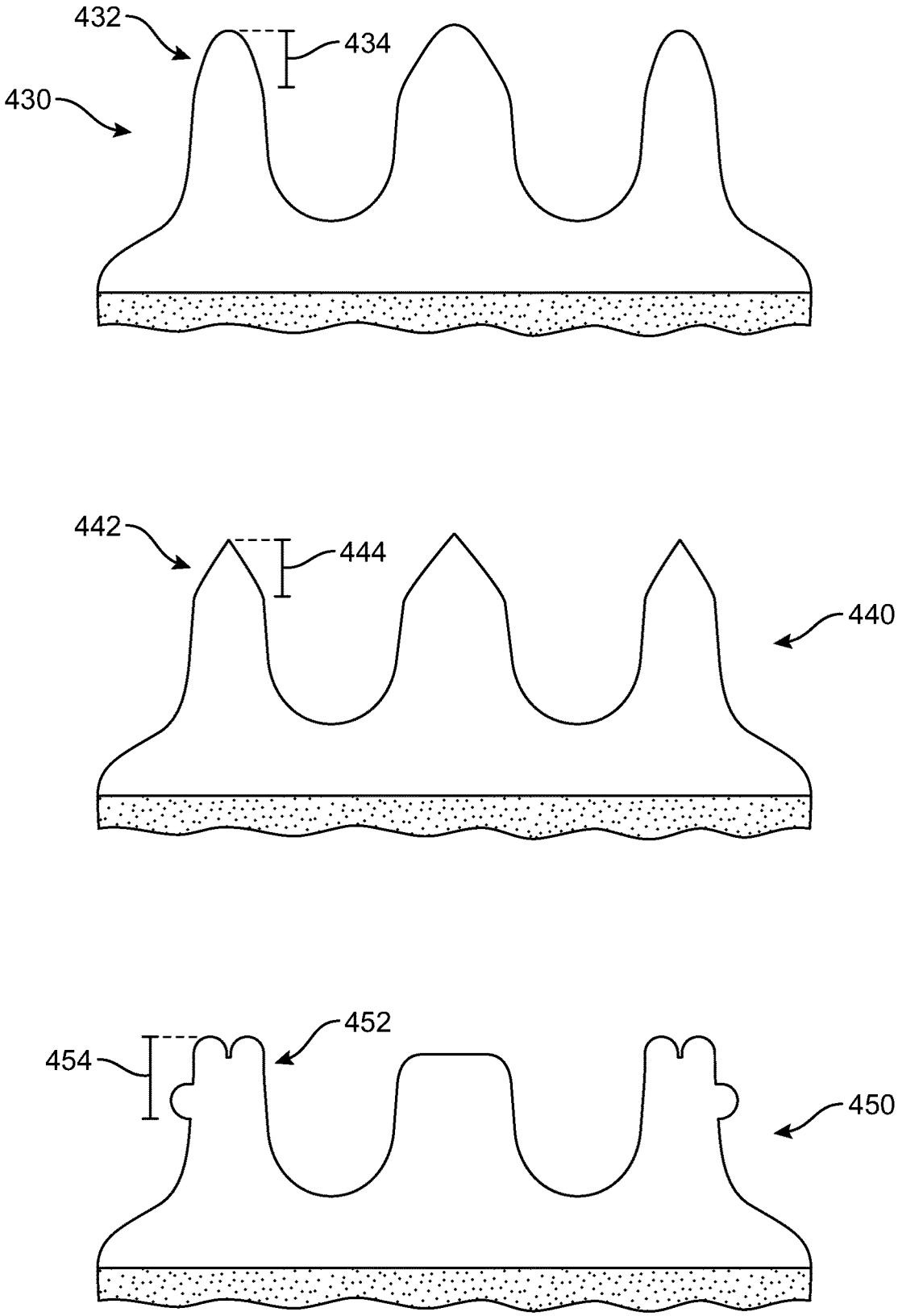
FIG. 4 presents some examples of different types of protruding portions.
Figure 5:
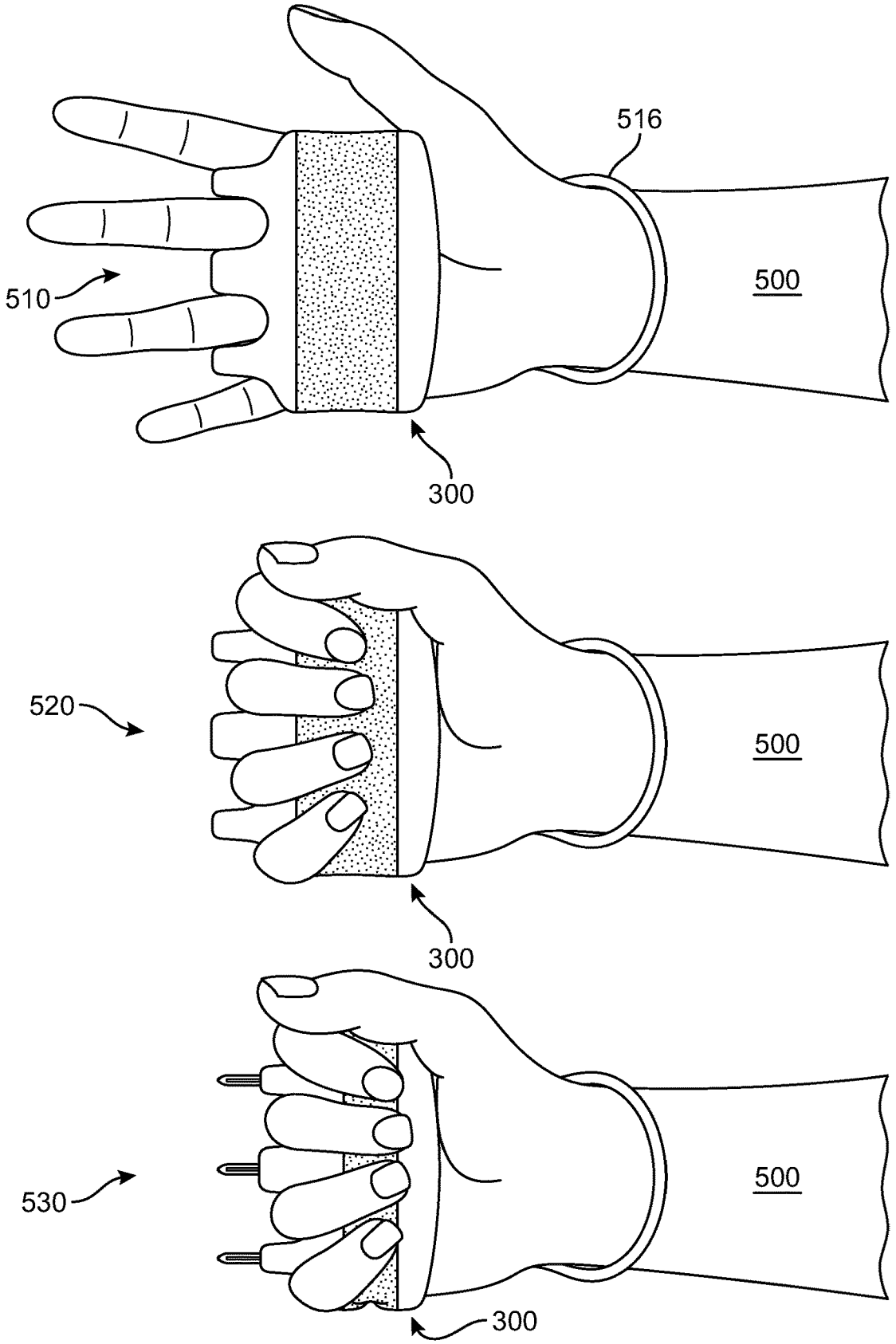
FIG. 5 is a schematic illustration of one possible sequence of using a device with a protruding portion.

In different implementations, the device may include provisions that enhance or increase the functionality of the device as a protective weapon. In some implementations, the first upper member 130 can vary from the depiction of FIGS. 1 and 2. For example, in some implementations, the upper member can include variations in its curvature. Referring to FIGS. 3-5, it can be seen that in some implementations, a second device 300 includes a second upper member 330 with a plurality of raised portions that are substantially larger and/or more elongated than those depicted for the first device. For purposes of clarity, these elongated raised portions will be referred to as protruding portions 310. The term protruding portions, rather than raised portions, is used to more clearly differentiate between the physical structures of each device. In one implementation, the protruding portions are configured to extend upward past the palm of a hand when the device is held or clasped, while the remainder of the device housing is carried in the palm.

In some implementations, the protruding portions extend distally outward from a base portion 398 of the second upper member 330 in an orientation substantially aligned with the vertical axis 294. In FIG. 3, a first protruding portion 312, a second protruding portion 314, and a third protruding portion 316 are illustrated. In different implementations, the protruding portions can be understood to extend from the region(s) previously associated with a raised portion as discussed with respect to FIGS. 1 and 2. However, in other implementations, such protruding portions can be disposed elsewhere along the second upper member 330.

In different implementations, two or more protruding portions may be of substantially similar shape and/or dimensions. In other implementations, each protruding portion may differ in shape and/or dimensions from other protruding portions. In FIG. 3, the first protruding portion 312 and the third protruding portion 316 can be understood to be substantially similar in size and dimensions, while the second protruding portion is larger in size. For example, first protruding portion 312 has a first width 322, the second protruding portion 314 has a second width 324, and the third protruding portion 316 has a third width 326. The first width 322 and the third width 326 are substantially similar, while the second width 324 is larger than either the first width 322 or the third width 326. In different implementations, the width of a protruding portion can range between 0.5 cm and 3 cm.

Furthermore, the height of each protruding portion can vary from one another, or can be similar. In FIG. 3, the three protruding portions can be understood to have heights that are substantially equal to one another. However, in different implementations, one protruding portion can extend further outward than another neighboring protruding portion. For purposes of reference, the height of a protruding portion will be provided relative to a nadir or lower edge 350 of an adjacent groove. In different implementations, the height of a protruding portion can range between 1 cm and 6 cm, though in other implementations the height can be greater than 6 cm. In the implementation of FIG. 3, the height of the protruding portions can range between approximately 1.5 cm to 3 cm. Alternatively the heights can be described by their size relative to the entire device. For example, in FIG. 3, the first protruding portion 312 has a first height 360 and the second device 300 has a second height 362. In different implementations, the size of the first height 360 relative to the second height 362 is between approximately 1:7 and 4:9. In FIG. 3, the second height 362 is approximately three times the size of the first height 360.

Furthermore, in different implementations, the height of a protruding portion will be at least as great as the thickness of a human finger, for example, between 1.5 cm and 2.1 cm. In one implementation, the first protruding portion will extend upward relative to the first groove to a height that is greater than the average thickness of a human finger. Thus, in most cases, the first protruding portion will have a height relative to an adjacent groove of at least 1.5 cm.

The second device 300 can also include provisions for greater steadiness and stability in the grip of the device. By elongation of the raised portions depicted in FIGS. 1 and 2 to form the protruding portions 310 as shown in FIGS. 3-5, it can be understood that the recesses disposed between neighboring or adjacent protruding portions are also deepened. In FIG. 3, the second device 300 includes a first groove 332 that can be compared to the first recess 132 of FIG. 1, and a second groove 334 that can be compared to the second recess 134 in FIG. 1. The term groove, rather than recess, is used to more clearly differentiate between the two concave regions in each device. Each of the first groove 332 and the second groove 334 are substantially deeper than the recesses of device 100. The depth of a groove can be understood to correspond to the heights of the adjacent protruding portions. Thus, the concavity is deepened when the raised portions are extended to form protruding portions. As a result, a user's fingers will be able to more securely grip or clutch the device even when only loosely or casually clasping the device, as there is less likelihood of a finger slipping out of the groove, or sliding over a protruding portion.

It should be understood that the devices with varying protruding portions described herein will include defensive components that are longer than those presented in FIGS. 1 and 2. In other words, the defensive components will be elongated to the extent necessary to ensure the outermost tip and at least a portion of the upper portion of each defensive component extends out of an opening (visible in FIG. 2) formed in an apex portion ("apex") 370 of the protruding portion when the device is activated, while remaining substantially or entirely enclosed within the housing when the device is deactivated. For purposes of reference, the apex refers to the region associated with the outermost end of the protruding portion. In the implementation of FIG. 3, the apex includes a substantially flat or rectangular surface associated with the outermost region of the protruding portion. However, as will be described below, in other implementations, the apex may differ.

In some implementations, by extending or otherwise elongating the size of a raised portion to provide a protruding portion, the devices can be configured to provide users with additional safety mechanisms. For example, in some implementations, one or more protruding portions can be used during an assault to preserve and concentrate a punch's force by directing the force toward a harder and smaller contact area (relative to the size and hardness of clenched fingers). The protruding portions can also result in increased tissue disruption, including an increased likelihood of injuring an attacker's bones on impact. In addition, by extending the perimeter of the finger grip regions (see for example a finger grip region 340 in FIG. 3) that are disposed between two adjacent protruding portions, the fingers of a user can more securely hold the weapon, where there is less likelihood of the device slipping out of a user's hand. Furthermore, these rounded finger grip regions also help to spread the counter-force across the user's hand that would otherwise be absorbed primarily by the user's knuckles, reducing the likelihood of damage to the user's fingers. Finally, in some cases, the protruding portions can decrease the chance of a user's fingers slipping out of the grooves and possibly contacting a defensive component.

Furthermore, in different implementations, one or more protruding portions can also be configured to receive or collect skin and/or DNA. For example, a user may punch an attacker while gripping the second device 300, such that the apex 370 of a protruding portion impacts the attacker. This contact between the apex and an attacker can allow particles of skin or other biological identifiers to collect into the opening formed in the apex 370.

As noted above, in different implementations, the geometry of the protruding portions can vary widely. Referring to FIG. 4, three examples of such variety are illustrated, though it should be understood that these are provided as examples only, and many other types of protruding portions are also possible. In FIG. 4, isolated views of a third upper member 430, a fourth upper member 440, and a fifth upper member 450 are depicted.

As a first example, in some implementations, a device may include an upper member as depicted in third upper member 430 has a protruding portion 432 that tapers in width as it approaches an apex portion 434. Thus, the outermost region of the protruding portion is substantially rounded, or curved. In some implementations, the apex portion 434 includes a convex surface. Thus, it can be seen that the apex portion 434 does not terminate in a sharp or pointed tip, but rather ends with a substantially round, half-sphere shape. In other words, the apex portion 434 has a semi-circular or semi-elliptical two-dimensional shape that gradually decreases in circumference.

In contrast, the fourth upper member 440 includes a protruding portion 442 with an apex portion 444 that has a generally pyramidal shape. Thus, the apex portion 444 has a generally rectangular or square two-dimensional shape that gradually decreases in area. While the implementation in this case shows the top or outermost peak of the apex portion 444 as being blunt, in other implementations, the apex portion 444 may terminate in a sharper or more pointed tip. Such an apex can allow a user to more narrowly focus the force applied against an attacker.

Referring to the fifth upper member 450, it can be seen that in different implementations, a protruding portion 452 can include a variety of texturing or irregular surface regions. In one implementation, portions of the protruding portion 452 including an apex portion 454 can include undulations, bumps, dimpling, apertures, ridges, grooves, or other texturing. This can enhance the functionality of the protruding portion during defensive moves. Furthermore, as noted previously, each protruding portion can include features that differ from other protruding portions in the same device. In FIG. 4, in the fifth upper member 450, while two protruding portions include a plurality of bumps, one protruding portion—disposed in the middle—remains smooth (without additional texturing).

In FIG. 5, a sequence is shown illustrating one example of use for the second device 300. In a first (initial) state 510, the second device 300 may be in the deactivated state. In this case, a user 500 is lightly holding the second device 300 in their palm. An optional wrist loop 516 ensures the device remains tethered to the user. In a subsequent second state 520, the user 500 closes their fingers such that the second device 300 is comfortably held in their fist. The user's fingers have wrapped around the device, between each of the protruding portions. In this state a user is able to respond naturally and quickly to any aggressor, and any forward thrusting, punching, slapping, and/or swiping motion while grasping the device can allow the user to apply substantial force upon an attacker via contact with the protruding portions. Even instinctive or untrained, reactive motions by the user can become more effective as the protruding portions provide the user with the advantage of preserving and concentrating the force of the first movements into the protruding portions. In addition, the protruding portions extend further outward than the edges of the user's fist, thereby protecting the user's first from the impact. Finally, a user may also wish to engage the full defensive capacity of the device. In a third state 530, the user has compressed the second device 300 with a force sufficient to extend the defensive components and allow the user to engage in 'clawing' action as needed, as described in greater detail in the above-referenced copending U.S. patent application Ser. No. 14/120,552.

Figure 6:
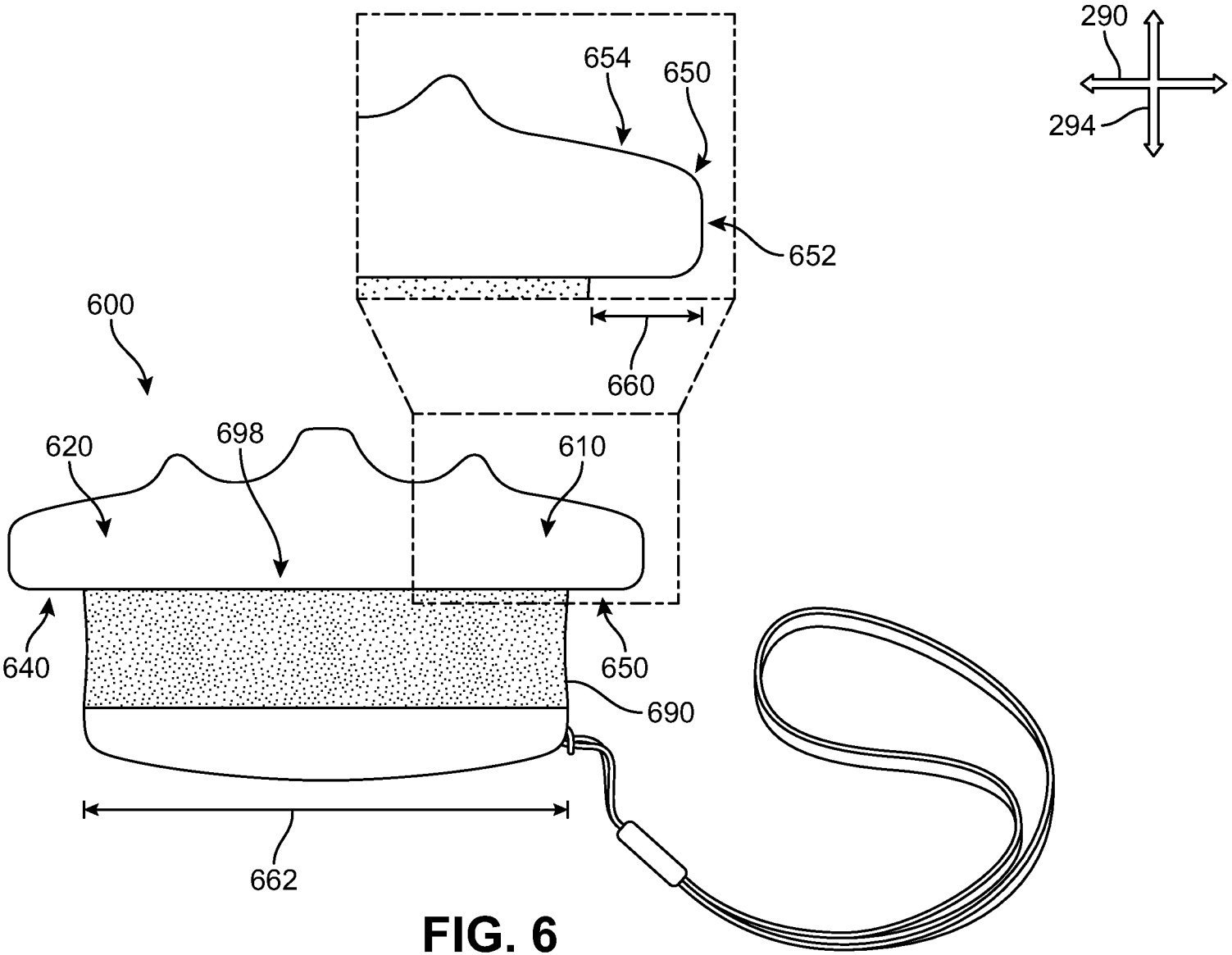
FIG. 6 is a side view of an implementation of a device with an arm portion.

In other implementations, the raised portions described in detail above can also or alternatively be disposed or formed elsewhere along a device. Referring to FIG. 6, a third device 600 is illustrated that includes a sixth upper member 630. For purposes of reference, the third device 600 can be understood to have a first side region 610 and a second side region 620. In this case, the second device 300 includes a protruding portion that extends outward from a first side region 610, and another protruding portion that extends form the second side region 620 of the device. For purposes of clarity, a protruding portion that extends outward from a side region in a manner substantially aligned with the longitudinal axis 290 will be referred to as an arm portion. For example, the third device 600 includes a first arm portion 640 and a second arm portion 650. In some implementations, an arm portion can include features, characteristics, and/or aspects described above with respect to raised portions and protruding portions. In one implementation, the arm portion(s) is configured to extend to a side, beyond the palm of a hand, when the device is held or clasped, while the remainder of the device housing is carried in the palm.

For example, the first arm portion 650 can extend distally outward from a base portion 698 of the sixth upper member 630, thereby increasing the overall width of the device. For purposes of reference, the outermost region of an arm portion is identified as an end portion 652. In some implementations, the end portion can correspond to the apex portions described above with respect to FIGS. 3-5. In the implementation of FIG. 6, the end portion includes a substantially flat or gently rounded rectangular surface associated with the outermost region of the arm portion. However, as will be described below, in other implementations, the dimensions and/or shape of an end portion may vary. It should also be noted that the height (along the vertical axis 294) of the arm portion is accommodated by an increase in height of the upper member itself. In other words, in some implementations, the primary portion of the upper member is lengthened to align with the height of the arm portion.

In addition, the width of an arm portion can vary from one device to another. For purposes of reference, the width of an arm portion will be provided relative to a side edge 690 of the sheath. In different implementations, the width of an arm portion (see for example a fourth width 660) can range between 0.5 cm and 3 cm, though in other implementations the width may be greater than 3 cm. In addition, a width of the device without an arm portion (see for example a fifth width 662) can range between approximately 4 cm and 13 cm. Thus, with the inclusion of an arm portion along one side, a width of the device can range between 4.5 cm and 16 cm. If a second arm portion is also included on the opposite side of the device, the width can be greater, as shown in FIG. 6. The width of the arm portion(s) can alternatively be described by its size relative to the entire device. For example, in FIG. 6, the first arm portion 650 has fourth width 660 and the housing of the third device 600 has a fifth width 662. In different implementations, the size of the fourth width 660 relative to the fifth width 662 is between approximately 1:10 and 1:3. In FIG. 6, the fifth width 662 is approximately 4.5 times the size of the fourth width 660.

Figure 7:
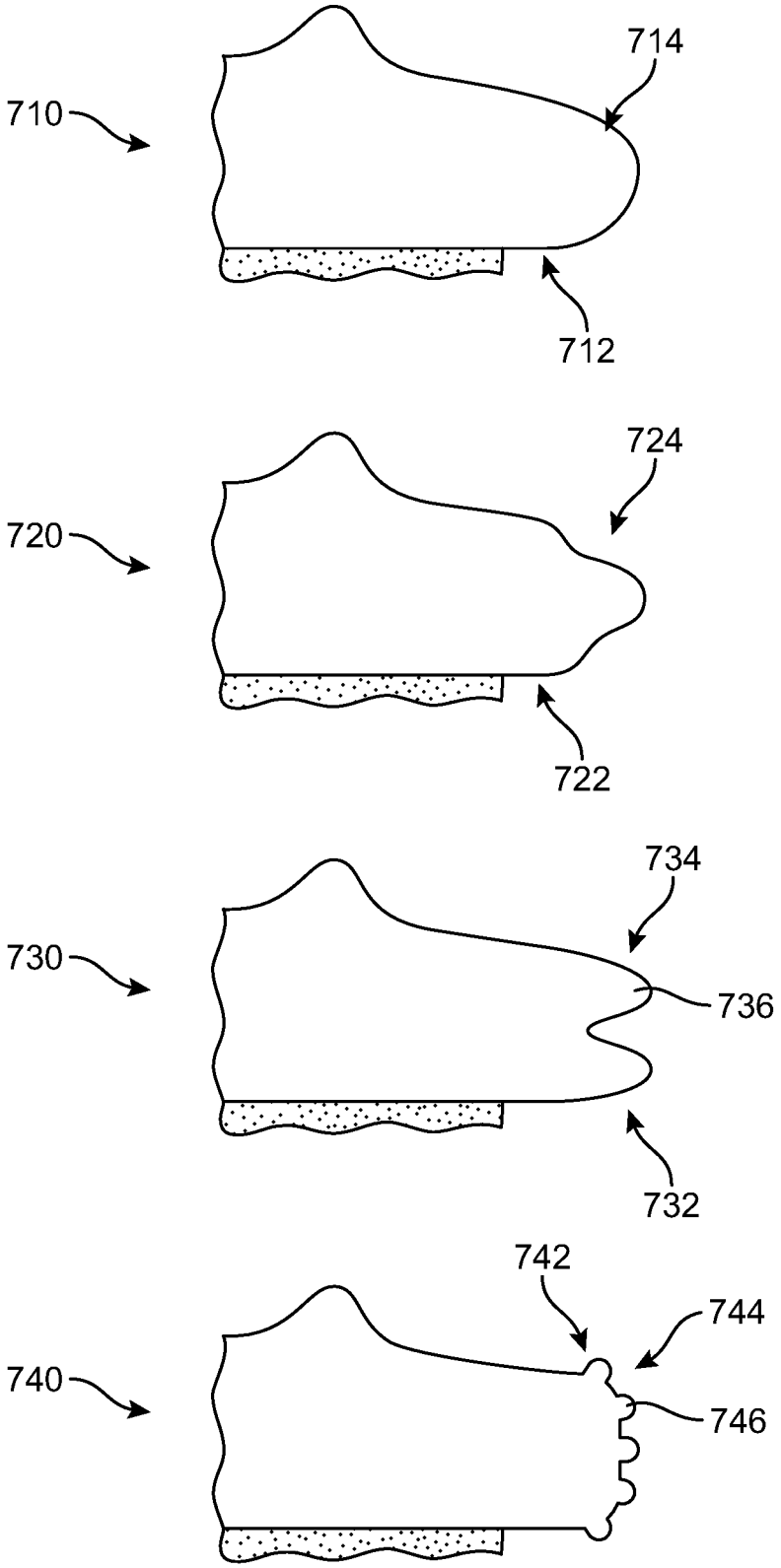
FIG. 7 presents some examples of different types of arm portions.
Figure 8:
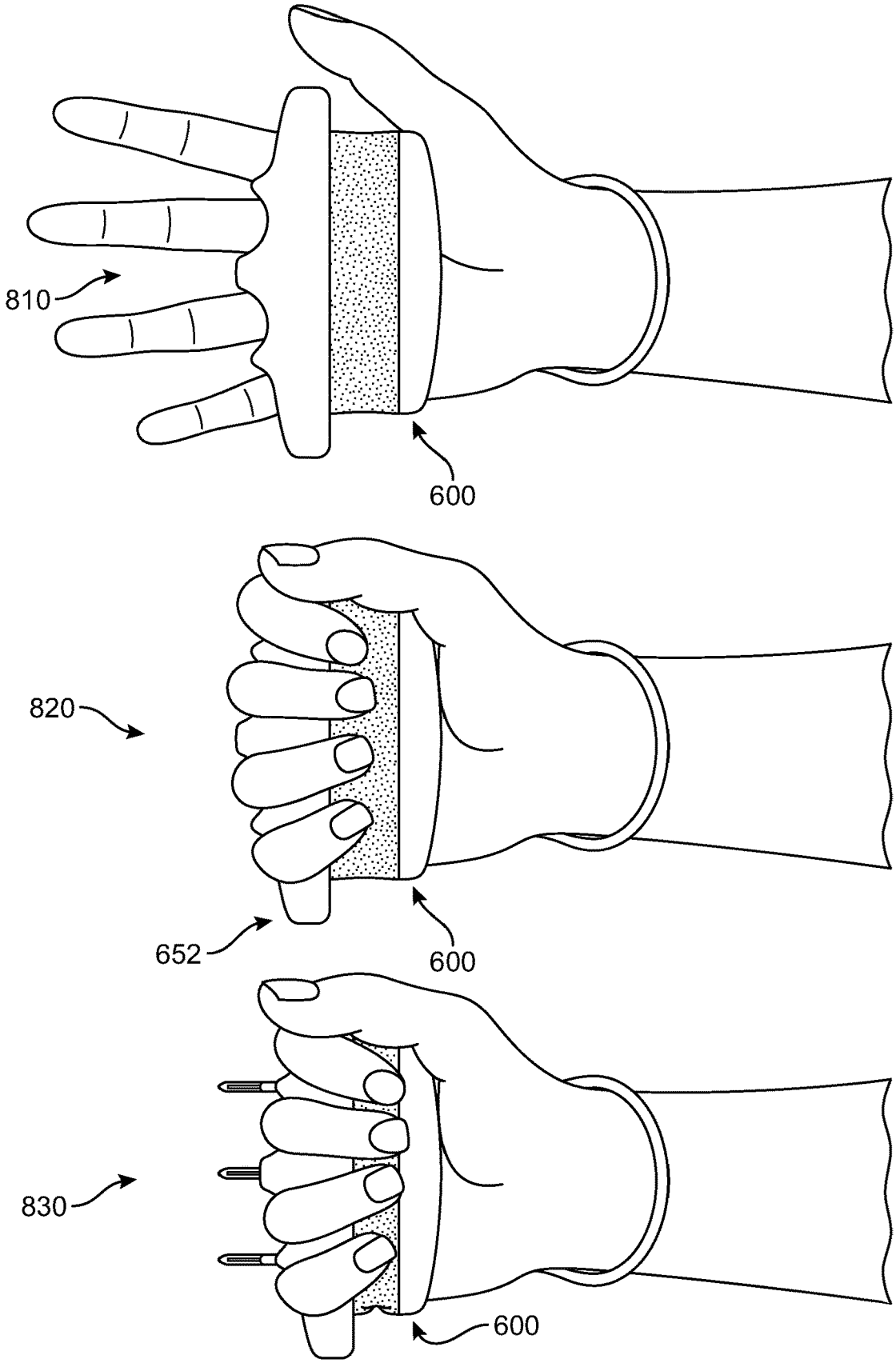
FIG. 8 is a schematic illustration of one possible sequence of using a device with an arm portion.

The third device 600 can also include provisions for greater steadiness and stability in the grip of the device. By elongation of the first side portion 136 or the second side portion 138 depicted in FIGS. 1 and 2 to form the arm portion as shown in FIGS. 6-8, it can be understood that the area upon which the user's fingers can rest or contact is also increased. In FIG. 6, the third device 300 includes a gripping surface 654 associated with the side of the arm portion 650 that faces upward, or is superior. The gripping surface 654 provides additional surface area for a user's fingers and/or palm to hold the device. In some implementations, a user can choose to spread one or more fingers across the gripping surface 654 for a more firm or balanced grip as they clasp the device. As a result, a user's fingers will be able to more securely grip or clutch the device even when only loosely or casually clasping the device, as there is less likelihood of a finger slipping off the device, particularly during an attack.

In different implementations, the geometry of the arm portions can also vary widely. Referring to FIG. 7, four examples of such variety are illustrated, though it should be understood that these are provided as examples only, and many other types of arm portions are also possible. In FIG. 7, isolated views of a seventh upper member 710, an eighth upper member 720, a ninth upper member 730, and a tenth upper member 740 are depicted.

As a first example, in some implementations, the seventh upper member 710 has an arm portion 712 that tapers in thickness as it approaches an end portion 714. Thus, the outermost region of the protruding portion is substantially rounded, or curved. In some implementations, the end portion 714 includes a convex surface. Thus, it can be seen that the end portion 714 does not terminate in a sharp or pointed tip, but rather ends with a substantially round, hemispherical shape that is blunt. In other words, the end portion 714 has a circular two-dimensional shape that gradually decreases in circumference, or is ovoidal in shape. In contrast, the eighth upper member 720 includes an arm portion 722 with an end portion 724 that narrows such that the thickness decreases abruptly and then continues toward a rounded end shape. Furthermore, the ninth upper member 730 includes an arm portion 732 with an end portion 734 that has two distinct elongated segments 736. Finally, the tenth upper member 740 includes an arm portion 742 with an end portion 744 that includes a plurality of bumps 746 formed on its outer surface. As noted earlier, in different implementations, such texturing can increase the range of impacts that the weapon can exert on an attacker. It should be understood that each of these examples can also be applicable to the geometry of the protruding portions described above, and similarly, the examples described with respect to the protruding portions may be applicable to the geometry of the arm portions.

In FIG. 8, a sequence is shown illustrating one example of use for the third device 600. In a first (initial) state 810, the third device 600 may be in the deactivated state. In this case, a user 800 is lightly holding the third device 600 in their palm. An optional wrist loop ensures the device remains tethered to the user. In a subsequent second state 820, the user 800 closes their fingers such that the third device 600 is comfortably held in their fist. The user's fingers have wrapped around the device, between each of the raised portions 850 of the device.

In this state a user is able to respond naturally and quickly to an aggressor, and any stabbing motion, side thrusts, and/or swiping motion while grasping the device can allow the user to apply substantial force upon an attacker via contact with the arm portion. Even instinctive or untrained, reactive motions by the user can become more effective as the arm portions provide the user with the advantage of preserving and concentrating the force of the first movements into the protruding portions. In addition, the protruding portions extend farther outward than the edges of the user's fist, thereby protecting the user's first from the impact. Finally, a user may also wish to engage the full defensive capacity of the device. In a third state 830, the user has compressed the third device 600 with a force sufficient to extend the defensive components and allow the user to engage in 'clawing' action as needed, as described in greater detail in the above-referenced U.S. patent application Ser. No. 14/120,552.

In some implementations, by extending or otherwise elongating a side of the upper member, the devices can be configured to provide users with additional safety mechanisms. For example, in some implementations, an arm portion can be used during an assault to preserve and concentrate a punch's force by directing the force toward a harder and smaller contact area (relative to the size and hardness of the side of a palm or hand). The arm portions can also result in increased tissue disruption, including an increased likelihood of injuring an attacker's bones on impact.

Furthermore, in different implementations, an arm portion can also be configured to receive or collect skin and/or DNA. For example, a user may make a stabbing motion against an attacker while gripping the third device 600, such that the end portion 652 impacts the attacker. This contact between the end portion and an attacker can allow particles of skin or other biological identifiers to collect into an optional opening (not illustrated here) in the end portion 652.

Figure 9:
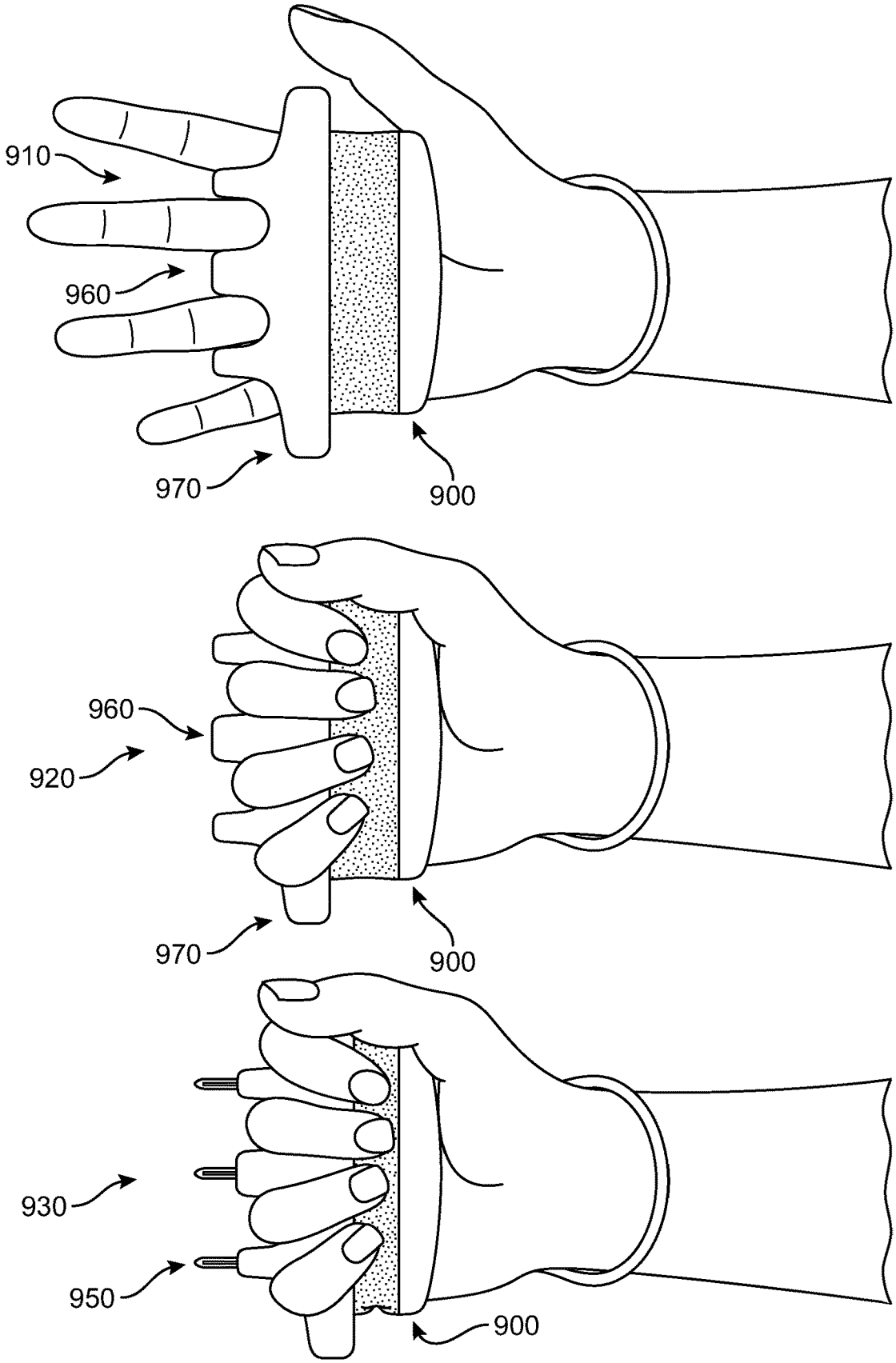
FIG. 9 is a side view of an implementation of a device with protruding portions and an arm portion.

In different implementations, a device may include both protruding portions and arm portions. An example of such a device is presented in FIG. 9 as a fourth device 900, in a first state 910 (deactivated), a second state 920 (deactivated, but positioned for use of protruding portions and/or arm portions), and a third state 930 (activated). Thus, in some cases, a device may include both a plurality of protruding portions 960 extending distally outward, as well as arm portions 970 that extends distally outward in an orientation substantially perpendicular to an orientation of the protruding portions. In the third state 930 a plurality of defensive components 950 have emerged from the compressed device. This type of device can be configured to perform all of the functions described above with respect to FIGS. 1-8.

Figure 10A:
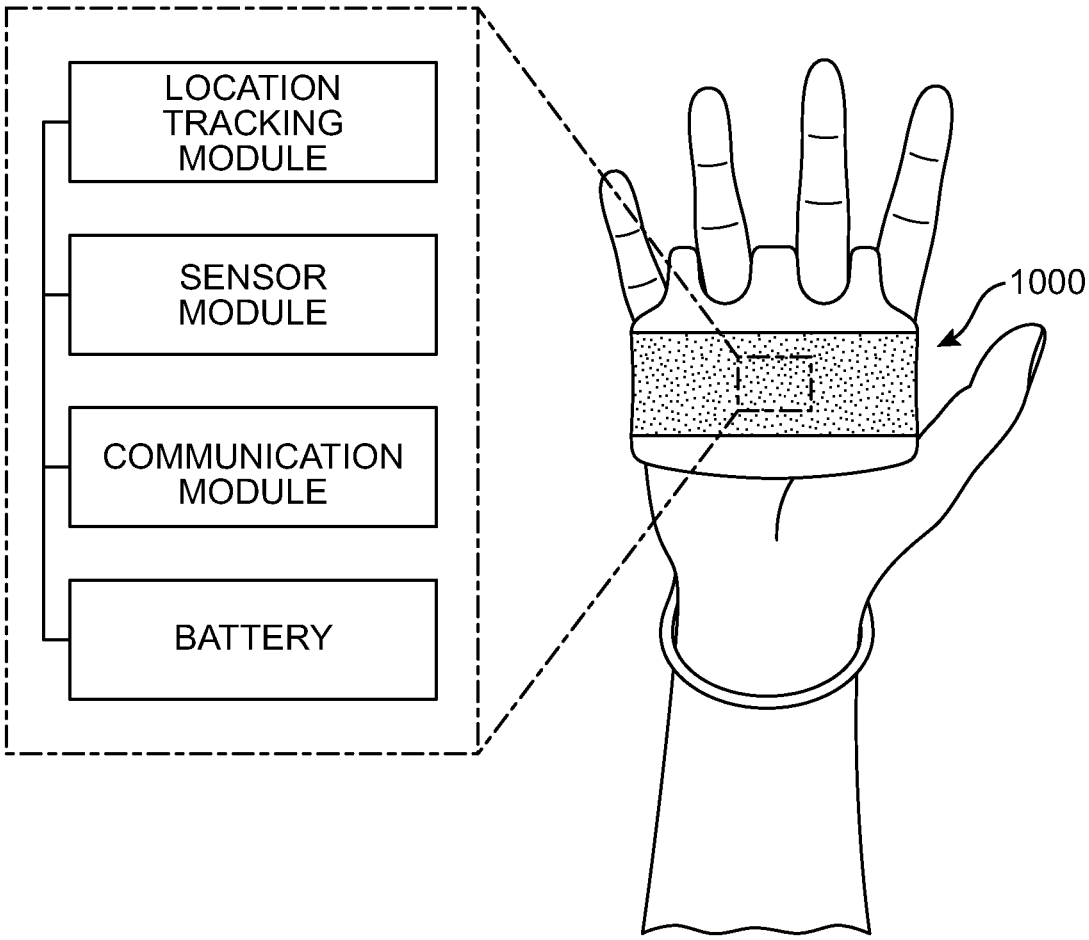
FIGS. 10A and 10B are two schematic overviews of an implementation of a protective device system.

In different implementations, a device may incorporate additional features to broaden the security options for a user. In some implementations, the device may include provisions for transmitting an alert to a specified recipient. For example, when activated, the device can be configured to transmit a signal to a user's family, friends, security services, and/or emergency services. As shown in FIG. 10A, in some implementations, a fourth device 1000 can include additional components, including a location tracking unit 1010, a sensing component 1020, an optional communication module 1030, and/or a battery 1040.

Furthermore, in some cases the device can include a Bluetooth module. In some implementations, the device can connect via the Bluetooth module to a nearby smartphone. An application on the smartphone may be preconfigured to receive these signals and transmit an alert accordingly. However, in other implementations, the device can transmit and/or receive signals directly with a network (for example via the communication module 1030), therefore bypassing the need for an additional carrier device, such as user's phone 1090.

Furthermore, the device can include a small, lightweight, long life battery to power the alert system. In some implementations, the battery will be in a sleep mode until the device is activated, and remain on until the alert is disabled, further extending the life of the battery. In addition, in some implementations, the device includes location tracking mechanism configured to provide a location of the device in real time and/or at the time the device was activated. For example, the device may include a GPS tracking unit that uses the Global Positioning System or other satellite-based location systems to determine and track its precise location at intervals. The recorded location data can be stored within the tracking unit, or it may be transmitted to a central location database, or internet-connected computer, using a cellular (GPRS or SMS), radio, or satellite modem embedded in the unit. This permits the device's location to be displayed against a map backdrop either in real time or when analyzing the tracker later, using GPS tracking software. In other implementations, the device can be configured to determine its location in a variety of other ways, including triangulation based on cellular network signals and/or wife signals.

As not all users will want or need such an alert system in their device, or there may be periods of time when such a system is not desired, the device can also include a switch that shifts the alert system from an enabled mode to a disabled mode, and from a disabled mode to an enabled mode. This can also improve battery life. Thus, when the alert system is disabled, activating the device by compression of the sheath will not trigger a transmission of a signal. However, if the alert system is enabled, activation will lead to a generation of a signal. The switch can be incorporated on the device itself, or can be accessible through a cloud service, website, SMS service, and/or mobile device application.

Figure 10B:
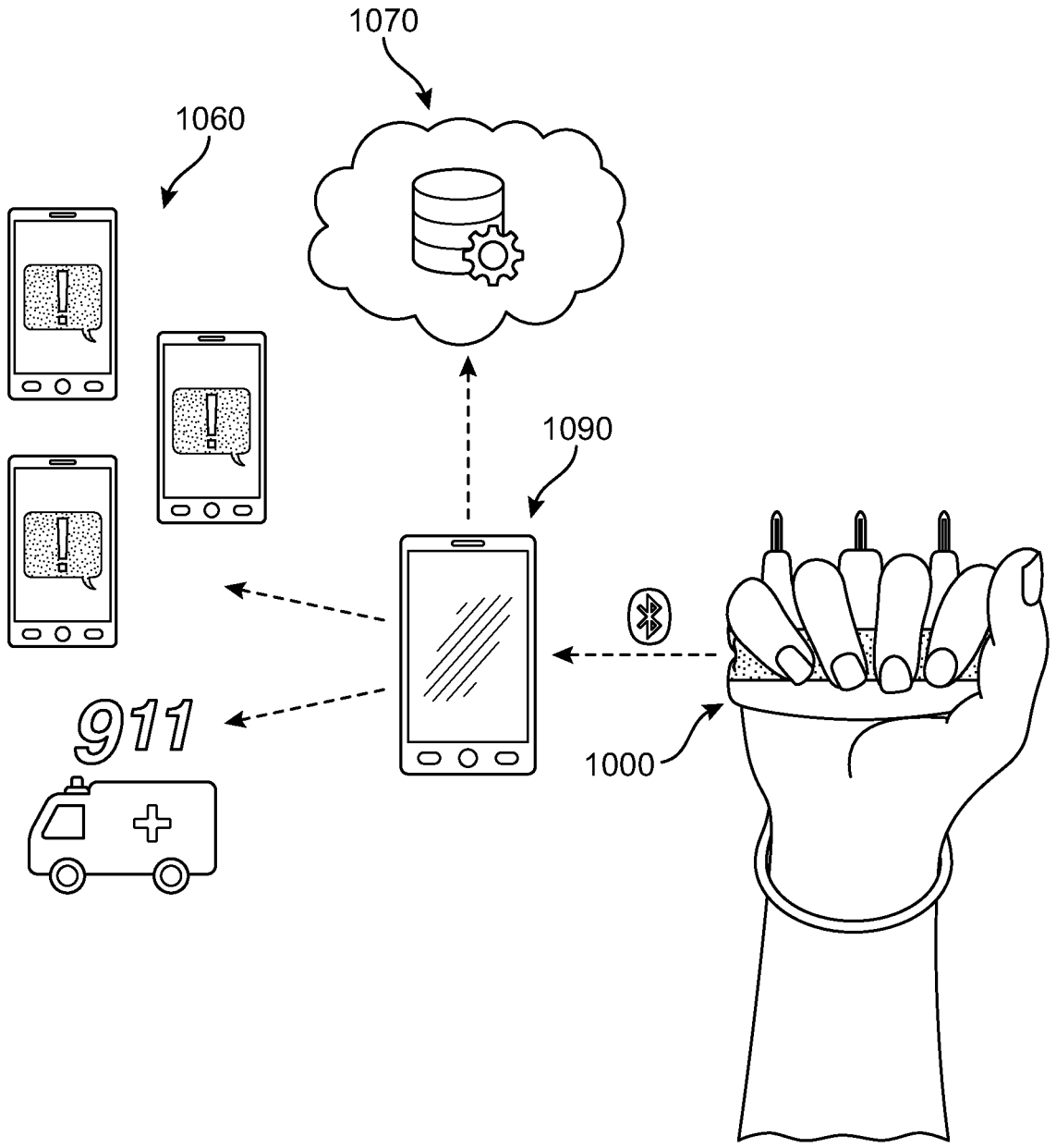

A schematic overview of the system is presented in FIG. 10B. In one implementation, a user can customize the type of alert to be sent through a settings application (for example, text message, phone call, e-mail, App-to-App, or other types of messaging, pre-established templates with location of device) and can also select the recipient(s), represented by phones 1060. In some implementations, the signal can be processed or routed by a cloud service 1070. Thus, following activation of the device, several people can be alerted, simultaneously or in a specific priority sequence until the alert is disabled by the user. Furthermore, an alert can be sent to security services, such as 911 or medical assistance.

Figure 11:
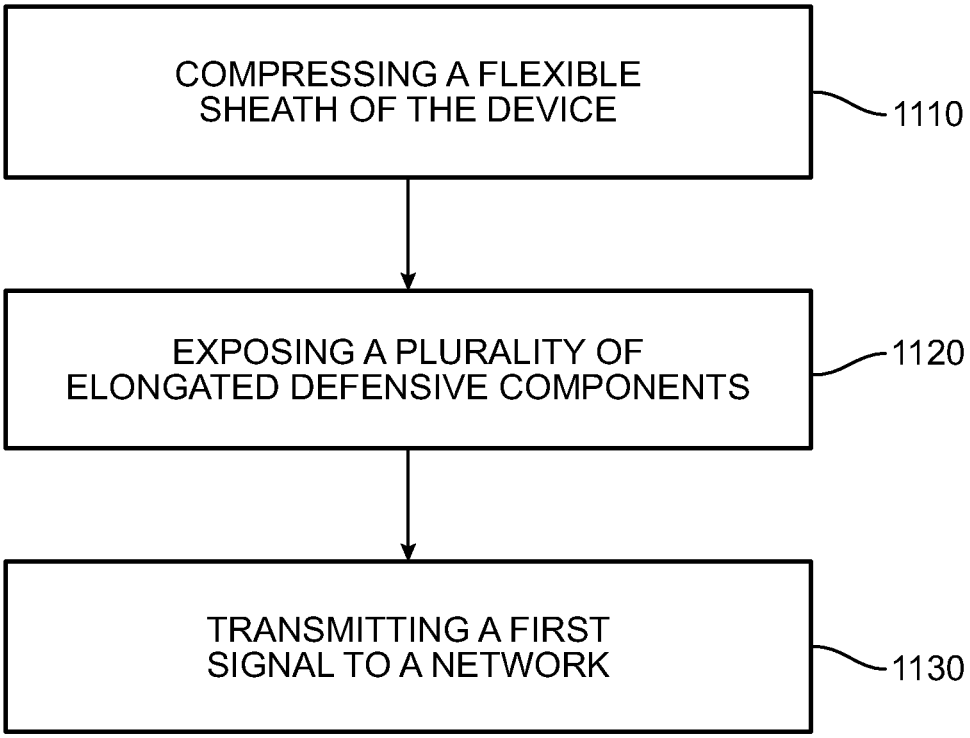
FIG. 11 is a flow chart illustrating an implementation of a method of using a protective device.

Referring to FIG. 11, an overview of a method of transmitting an alert from a device is presented in a flow chart. In a first step 1110, the device can be activated, or the flexible sheath may be compressed, such that an upper member and a lower member of the device move closer together. A second step 1120 involves exposing a plurality of elongated defensive components through openings in the upper member. A third step 1130 includes transmitting a first signal to a network when contact between a first sensing component and a second sensing component occurs.

In different implementations, the method can include additional or optional steps. For example, in some implementations, the device may be configured to transmit a second signal to a remote mobile device, and/or local law enforcement agency. In another implementation, the method involves transmitting a position of the device to a network when contact between a first sensing component and a second sensing component occurs. In some implementations, a user may switch the device from a disabled mode to an enabled mode before compressing the device to trigger the alert.

It should be understood that each of these operations can be associated with a system comprising one or more computers and one or more storage devices. The devices described herein can include computing devices, storage devices, and/or systems as described below. In one implementation, the one or more storage devices store instructions that, when executed by the one or more computers, cause the one or more computers to perform the aforementioned operations.

Figure 12:
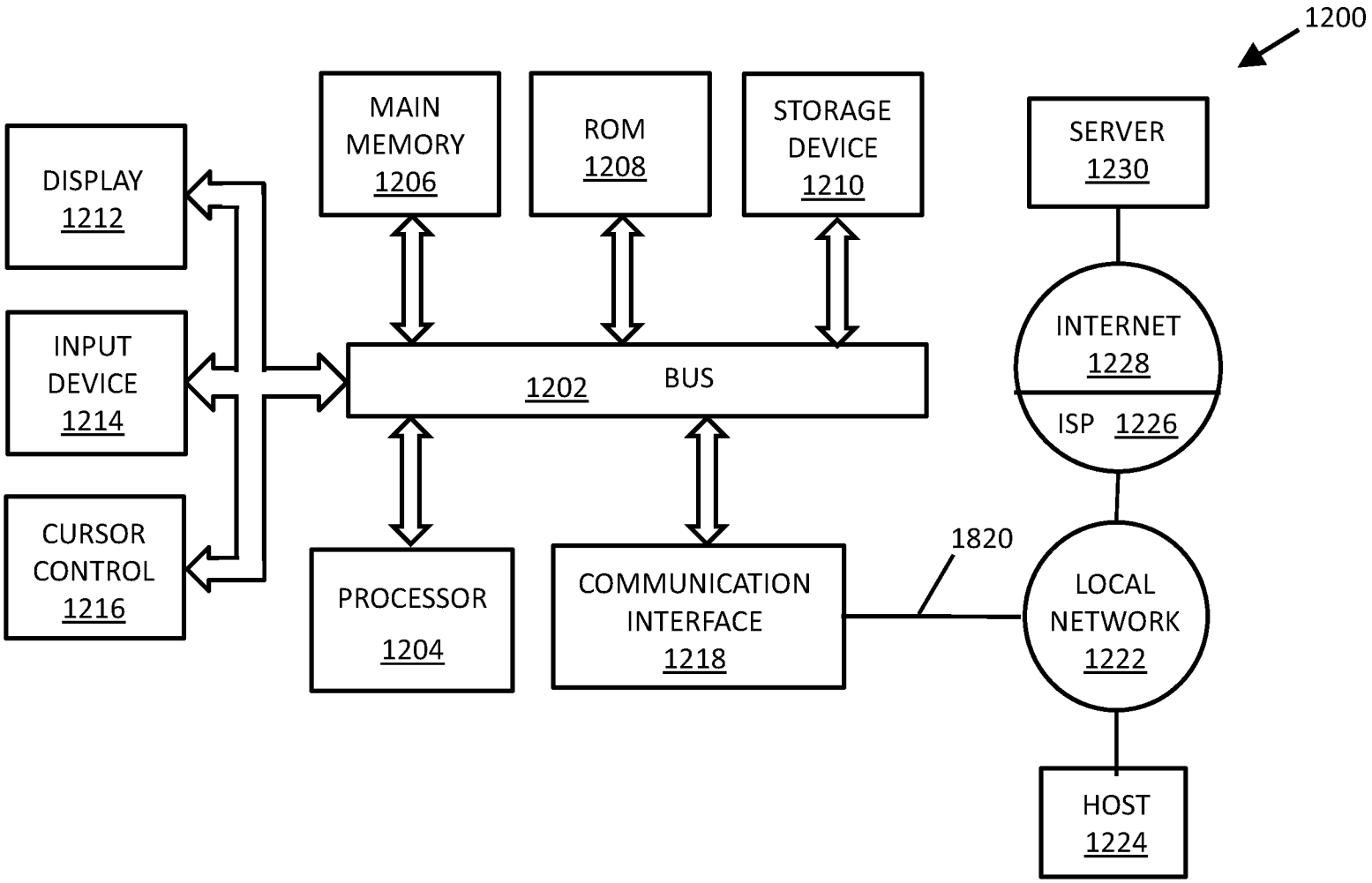
FIG. 12 is a block diagram showing an implementation of a computer system.

FIG. 12 illustrates a block diagram showing a computer system 1200 upon which aspects of this disclosure may be implemented. Computer system 1200 includes a bus 1202 or other communication mechanism for communicating information, and a processor 1204 coupled with bus 1202 for processing information. Computer system 1200 also includes a main memory 1206, such as a random access memory (RAM) or other dynamic storage device, coupled to bus 1202 for storing information and instructions to be executed by processor 1204. Main memory 1206 also may be used for storing temporary variables or other intermediate information during execution of instructions to be executed by processor 1204.

The computer system 1200 can implement, for example, one or more of, or portions of the modules and other component blocks included in the system illustrated in FIG. 10. Examples can include, but are not limited to the location tracking unit 1010, the sensing component 1020, the communication module 1030, the Bluetooth module, and/or the battery 1040.

The computer system 1200 can also implement, for example, one or more of, or portions of the operations illustrated in FIG. 11. Examples can include, but are not limited to, operations of activating the device, transmitting signals to a network, processing and analyzing sensor data, and/or receiving information from remote devices. Other examples include transmitting a signal to a remote mobile device, and/or local law enforcement agency, transmitting a position of the device to a network, switching or toggling the device from a disabled mode to an enabled mode.

Computer system 1200 can further include a read only memory (ROM) 1208 or other static storage device coupled to bus 1202 for storing static information and instructions for processor 1204. A storage device 1210, such as a flash or other non-volatile memory can be coupled to bus 1202 for storing information and instructions.

Computer system 1200 may be coupled via bus 1202 to a display 1212, such as a liquid crystal display (LCD), for displaying information, for example, associated with the status of the alert or a response from a receiver of the signal. One or more user input devices, such as the example user input device 1214 can be coupled to bus 1202, and can be configured for receiving various user inputs, such as user command selections and communicating these to processor 1204, or to a main memory 1206. The user input device 1214 can include physical structure, or virtual implementation, or both, providing user input modes or options, for controlling, for example, a cursor, visible to a user through display 1212 or through other techniques, and such modes or operations can include, for example virtual mouse, trackball, or cursor direction keys. Instructions may be read into main memory 1206 from another machine-readable medium, such as storage device 1210. In some examples, hard-wired circuitry may be used in place of or in combination with software instructions to implement the operations described herein.

The term "machine-readable medium" as used herein refers to any medium that participates in providing data that causes a machine to operate in a specific fashion. Such a medium may take forms, including but not limited to, non-volatile media, volatile media, and transmission media. Non-volatile media can include, for example, optical or magnetic disks, such as storage device 1210. Transmission media can include optical paths, or electrical or acoustic signal propagation paths, and can include acoustic or light waves, such as those generated during radio-wave and infra-red data communications, that are capable of carrying instructions detectable by a physical mechanism for input to a machine.

Computer system 1200 can also include a communication interface 1218 coupled to bus 1202, for two-way data communication coupling to a network link 1220 connected to a local network 1222. Network link 1220 can provide data communication through one or more networks to other data devices. For example, network link 1220 may provide a connection through local network 1222 to a host computer 1224 or to data equipment operated by an Internet Service Provider (ISP) 1126 to access through the Internet 1228 a server 1230, for example, to obtain code for an application program.

While various embodiments have been described, the description is intended to be exemplary, rather than limiting, and it is understood that many more embodiments and implementations are possible that are within the scope of the embodiments. Although many possible combinations of features are shown in the accompanying figures and discussed in this detailed description, many other combinations of the disclosed features are possible. Any feature of any embodiment may be used in combination with or substituted for any other feature or element in any other embodiment unless specifically restricted. Therefore, it will be understood that any of the features shown and/or discussed in the present disclosure may be implemented together in any suitable combination. Accordingly, the embodiments are not to be restricted except in light of the attached claims and their equivalents. Also, various modifications and changes may be made within the scope of the attached claims.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various examples for the purpose of streamlining the disclosure. This method of disclosure is not to be interpreted as reflecting an intention that the claims require more features than are expressly recited in each claim. Rather, as the following claims reflect, inventive subject matter lies in less than all features of a single disclosed example. Thus the following claims are hereby incorporated into the Detailed Description, with each claim standing on its own as a separately claimed subject matter.

What is claimed is:

1. A protective device comprising:

a housing including an upper member, a lower member, and a flexible sheath that extends between the upper member and the lower member, wherein:

the upper member is more rigid than the flexible sheath, the housing surrounds a cavity, and the housing is sized and dimensioned to fit in a human hand;

a first protruding portion and a second protruding portion, each protruding portion extending distally outward from the upper member, and each protruding portion tapering in width as the protruding portions extend outward from the upper member toward an apex portion, wherein a distal end of at least one protruding portion includes an opening configured to collect skin or other biological identifiers when the distal end of the protruding portion is used to strike an attacker; and a first defensive component disposed within the cavity, the first defensive component being elongated in a direction parallel to an orientation of the first protruding portion and including a body portion and an upper portion, wherein the body portion has an outer surface that is blunt, and the upper portion includes a blunt concave surface extending from the body portion to an outermost tip portion, wherein the device is configured for attaining selectively an activated state and a deactivated state, wherein the flexible sheath is compressed in the activated state such that a dimension of the housing is decreased.

2. The protective device of claim 1, further comprising a first groove disposed between the first protruding portion and the second protruding portion.

3. The protective device of claim 1, further comprising a third protruding portion extending distally outward from the upper member, the first protruding portion, the second protruding portion, and the third protruding portion being oriented in a parallel configuration.

4. The protective device of claim 3, further comprising a second groove disposed between the second protruding portion and the third protruding portion.

5. The protective device of claim 1, wherein the lower member is more rigid than the flexible sheath.

6. The protective device of claim 1, wherein the apex portion of the first protruding portion is rounded.

7. The protective device of claim 1, wherein the apex portion of the first protruding portion includes a plurality of bumps.

8. The protective device of claim 1, further comprising an arm portion extending distally outward in an orientation perpendicular to an orientation of the first protruding portion.

* * * * *